United States Patent [19]

Hurn et al.

[11] 4,303,475

[45] Dec. 1, 1981

[54] NUCLEAR REACTOR SYSTEM WITH ALIGNED FEEDWATER AND SUPERHEATER PENETRATIONS

[75] Inventors: Edwin J. Hurn; John A. Kissinger, both of San Diego, Calif.

[73] Assignee: General Atomic Company, San Diego, Calif.

[21] Appl. No.: 968,345

[22] Filed: Dec. 11, 1978

[51] Int. Cl.[3] ..... G21C 17/28

[52] U.S. Cl. ..... 376/394

[58] Field of Search ..... 176/65, 87

[56] References Cited

U.S. PATENT DOCUMENTS

| | | | |
|---|---|---|---|
| 3,547,187 | 12/1970 | Cook et al. | 176/65 X |
| 3,719,558 | 3/1973 | Leclou | 176/65 X |
| 4,025,387 | 5/1977 | Haferkamp et al. | 176/65 X |
| 4,057,467 | 11/1977 | Kostrzewa | 176/65 X |
| 4,098,329 | 7/1978 | Culver | 176/65 X |
| 4,162,191 | 7/1979 | Cella | 176/65 X |

*Primary Examiner*—Peter A. Nelson

*Attorney, Agent, or Firm*—Fitch, Even, Tabin, Flannery & Welsh

[57] ABSTRACT

A nuclear reactor system is described wherein a prestressed concrete reactor vessel is provided with a main cavity for the reactor core and at least one subsidiary cavity for a steam generator. At least two feedwater penetrations are provided in the reactor vessel communicating between the exterior of the reactor vessel and the subsidiary cylindrical cavity. A superheater penetration is provided aligned with the axis of the cavity with the feedwater penetrations and the superheater penetration having mutually parallel axes. Superheater outlet means are positioned in the superheater penetration and include a tubesheet positioned a substantial distance from both the subsidiary cylindrical cavity and the exterior of the reactor vessel.

6 Claims, 4 Drawing Figures

NUCLEAR REACTOR SYSTEM WITH ALIGNED FEEDWATER AND SUPERHEATER PENETRATIONS

This invention relates generally to nuclear reactor systems and, more particularly, to a nuclear reactor system wherein a steam generator is positioned within a cavity in a prestressed concrete reactor vessel.

Since the advent of nuclear power reactors, substantial steps have been taken toward the efficient and economical production of electrical power from thermal energy derived from these reactors. An important factor in the attainment of this goal is the operation of such reactors at temperatures sufficiently high to enable the direct production of steam at temperatures and pressures suitable for high efficiency operation of steam turbines. In this connection, present day reactor technology has led to the development of high temperature gas cooled reactors which, when employed with a suitable steam turbine system, have the capability of producing electrical power of a quantity and at a cost which meet requirements of the utility industry.

In general, nuclear power plants employing high temperature gas cooled reactors enclose the reactor in a pressure vessel through which a fluid coolant, such as gaseous helium, is circulated to withdraw thermal energy liberated by the reactor. Steam for the operation of the turbines is normally obtained by the transfer of heat from the coolant to the fluid of a water/steam system. Conventionally, such heat transfer is accomplished in a steam generator wherein the thermal energy withdrawn from the reactor is utilized to produce superheated steam.

The use of a prestressed concrete reactor vessel to enclose the reactor core in a reactor cavity provides significant advantages, both with respect to containment and shielding from radiation, and with respect to containment of potential accidents. In certain designs, separate subsidiary cavities, usually cylindrical in shape, are provided for containing the steam generator or generators employed in the reactor system. Naturally, it is desirable to make the most efficient and economical use of the volume of the subsidiary cavity or cavities, either by reducing the size of the cavity for a given capacity heat exchanger, or enabling the use of a larger capacity heat exchanger for a given cavity size.

Accordingly, it is an object of the present invention to provide an improved nuclear reactor system design wherein a maximal use of the vessel cavity volume for the steam generator or generators is made.

Another more general object of the invention is to provide an improved nuclear reactor system.

A further and more specific object of the invention is to provide an improved nuclear reactor system having a prestressed concrete reactor vessel which has a cavity for the reactor core and at least one separate cavity for containing a steam generator.

Other objects of the invention will become apparent to those skilled in the art from the following description taken in connection with the accompanying drawings wherein.

Figure 1:
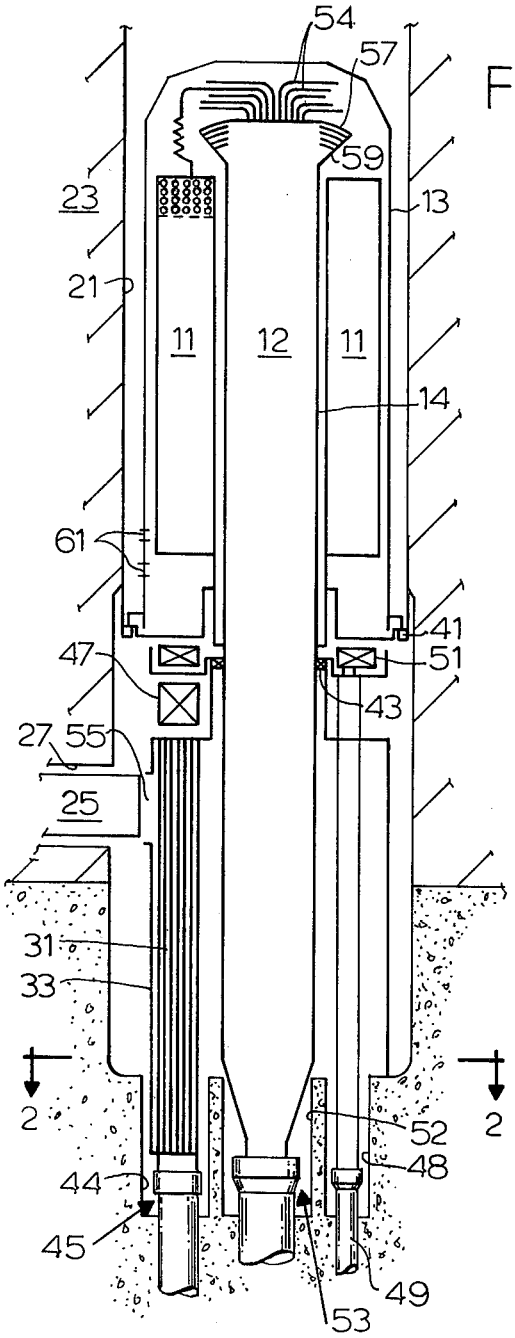
FIG. 1 is a full section schematic view of a portion of the reactor system of the invention.

Very generally, the nuclear reactor system in which the invention is employed has a prestressed concrete reactor vessel 23 with a main cavity therein for the reactor core and at least one subsidiary cylindrical cavity 21 therein for a steam generator. At least two feedwater penetrations 48 are provided in said reactor vessel communicating between the exterior of said reactor vessel and the subsidiary cylindrical cavity. The feedwater penetrations having mutually parallel axes parallel to an extension of the axis of the subsidiary cylindrical cavity. Feedwater inlet means 49 pass through the feedwater penetrations. A superheater penetration 52 is also provided communicating between the exterior of the reactor vessel and the subsidiary cylindrical cavity. The superheater penetration has an axis parallel to the axes of said feedwater penetrations and is substantially aligned with the axis of said subsidiary cylindrical cavity. Superheater outlet means in said superheater penetration, said superheater outlet means 53 include a tube sheet 113 (FIG. 4) positioned in the superheater penetration a substantial distance from both said subsidiary cylindrical cavity and the exterior of said reactor vessel.

Referring now more particularly to FIG. 1, the schematic diagram therein is that of a steam generator such as may be employed in a nuclear reactor. The generator is mounted within a well or subsidiary chamber 21 formed in the prestressed concrete reactor pressure vessel 23. The vessel also has a main chamber, not shown, for the reactor core, also not shown. Hot gas is supplied to the steam generator from the main chamber through a conduit 25 positioned in a duct 27 of the reactor vessel 23. The gas circulates first up and then down through the steam generator, and finally passes back upwardly to a gas circulator, not shown, positioned in the well 21 above the steam generator. The gas circulator then returns the gas to the reactor core through suitable ducting, not shown. A reactor system of this general type is described in U.S. Pat. No. 4,005,681 assigned to the assignee of the present invention.

The illustrated steam generator includes banks or bundles 31 of reheater tubes positioned toward the lower end of the well 21 and framed by a suitable housing 33 of metal plates or the like. Positioned above the reheater tube bundle in axial alignment therewith is a bundle of helical coils nested together to form an annular shape and comprising an annular bundle 11. The bundle 11 is provided with a housing 13 of metal plates or the like. The bundle 11 comprises the economizer-evaporator and first superheater section of the steam generator.

The second superheater section is a tube bundle 12 comprised of a plurality of elongated straight tubes which are positioned in the space defined by both the tube bundles 31 and the annular tube bundle 11. A housing 14, comprised of suitable metallic plates or the like, is formed surrounding the tube bundle 12. The housings 13 and 14 are suitably supported by a mounting flange 41 mounted within the well 21 by suitable means, not shown. Differential thermal expansion between the housing 14 and the lower housing 33 is accommodated by an annular sliding seal indicated at 43.

Hot and cold reheater fluids are supplied to and exit from the reheat tube bundles 31 by suitable headers 45. The hot reheat and cold reheat tubes of the reheater tube bank are interconnected by hairpin shaped crossover tubes indicated generally at 47.

Feedwater for the steam generator illustrated is supplied through a feed water input conduit 49 which passes upwardly through the lower portion of the steam generator and connects with the tubes in the tube bundle 11 through expansion leads 51. Outflow at the top of the tube bundle 11 passes to the upper end of the tube bundle 12 through crossover loops 52. Superheated steam exits the lower end of the tube bundle 12 through the superheater header 53.

Incoming hot gas from the reactor core enters the penetration through the duct 27 and conduit 25 and passes through an opening 55 in the housing 33 for the reheat tube bundles 31. After circulating over the tubes in the bundles 31, the gas enters the open lower end of the housing 14 and passes upwardly over the tubes in the tube bundle 12. A gas flow deflection plate 57 is suitably mounted at the upper end of the housing 14, as is a plurality of vertical fins 59. The gas passes through the space between the upper open end of the housing 14 and the plate 57 between the fins 59 and is then directed downwardly over the helical tubes in the tube bundle 11. After passing over the helical tubes in the tube bundle 11, the gas passes through ports 61 in the outer wall of the housing 13 and passes upwardly between the housing 13 and the wall of the penetration 21 to the gas circulator, not shown.

Figure 2:
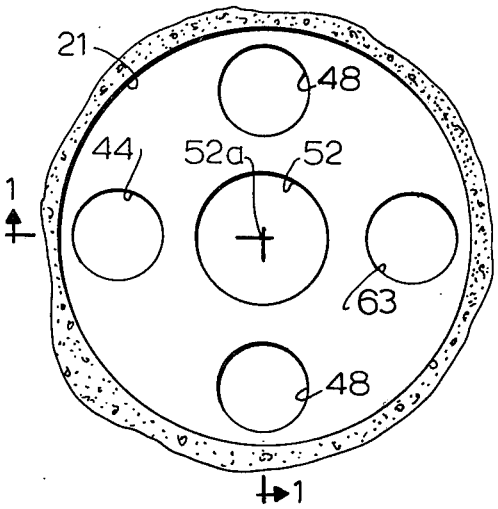
FIG. 2 is a sectional view taken along the line 2—2 of FIG. 1.

FIG. 2 illustrates the placement of the penetrations with respect to the outer periphery of the heat exchanger chamber 21. More particularly, the central penetration 52 for the superheater header is centrally located and has an axis 52*a* aligned with the axis of the chamber 21. The reheater inlet penetration 44 is provided radially spaced from the superheater penetration 52 and having an axis parallel with the axis 52*a* of the superheater penetration. The reheat outlet penetration 63 is diametrically opposed and symmetrically located within the circumference formed by the outline of the chamber 21 with respect to the penetration 44. The feedwater inlet penetrations 49, of which there are two, are spaced within the outline of the cylindrical chamber 21 and are diametrically opposed and symmetrically located therein. The axes of the penetrations 49 are parallel with the axis 52*a* and the axes of the reheater inlet and outlet penetrations 44 and 63. The diameter upon which the penetrations 49 are located is perpendicular with the diameter upon which the penetrations 44 and 63 are located.

By providing for two feedwater inlet penetrations and associated headers, the diameter of the penetrations may be reduced as opposed to the required diameter of a single penetration for the same feedwater inlet flow. This enables a consequent reduction in the overall diameter of the chamber 21, since required radius for accommodating the feedwater inlet penetrations is reduced over the required radius for a single penetration. Conversely, for a given size of cavity 21, a larger amount of feedwater may be introduced using the twin penetration concept illustrated. Thus, the use of the steam generator cavity volume is maximized.

Figure 3:
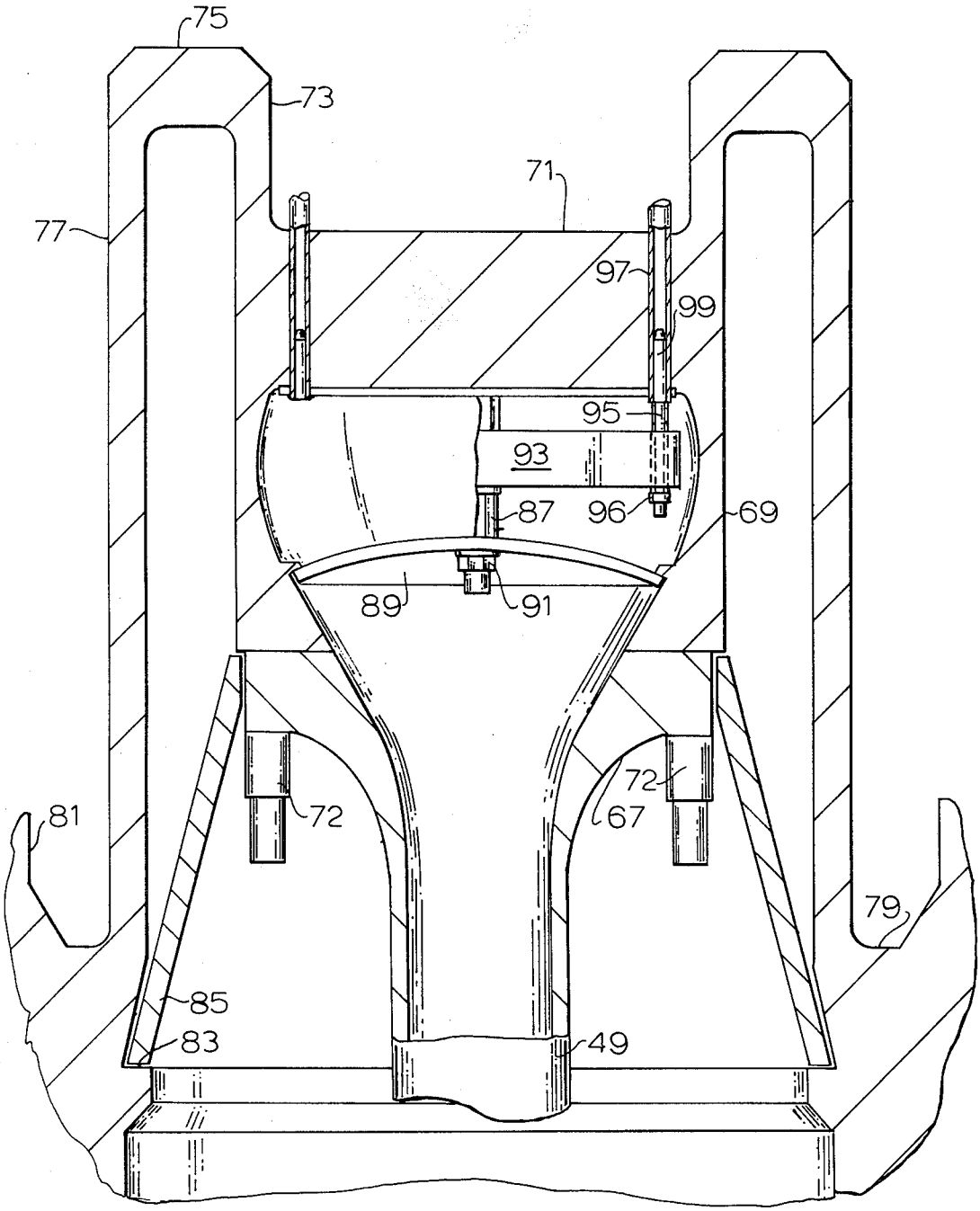
FIG. 3 is an enlarged cross-sectional view of the feedwater inlet means of the system of FIG. 1.

From time to time, in-service inspection of the pressure boundary and the tubes of the feedwater tubesheet may become necessary. In order to provide access for such inspection, while at the same time minimizing the diameter of the feedwater penetrations, the feedwater inlet pipe or conduit 49 is made removable in each of the two feedwater penetrations. More particularly, and referring to FIG. 3, the feedwater pipe 49 is shown as having a flanged end 67. This is secured to the lower end of an annular wall 69 depending from the feedwater tubesheet 71. Suitable seals, not shown, are provided at the interface between the flange 67 and the wall 69, and the attachment is secured by suitable bolted connectors 72.

The tubesheet 71 spans the central portion of the feedwater penetration 49 and is held in position by an integral sleeve 73 depending from an annular wall 75. The annular wall 75 is formed at the top of an outer sleeve 77 which extends upwardly and encloses the entire feedwater header within the penetration 49. The sleeve 77 is supported at its lower end by an annular ledge 79 integral with the sleeve 77. The ledge 79 projects inwardly from the metal liner 81 of the feedwater penetration. The space between the liner 81 and the sleeve 77 may be filled with suitable insulation, not shown. The assembly of the annular wall 69, the tubesheet 71, the sleeve 73, wall 75, and sleeve 77 may be formed integral with the ledge 79 and liner 81 by suitable welds, not shown.

The interior of the liner 81 just below the level of the ledge 79 is shaped to form a further annular ledge 83. A frustoconical sleeve 85 rests upon the annular ledge 83 and extends upwardly to abut the lower edge of the cylindrical wall 69 just outside of the flange 67. The frustoconical sleeve 85 thereby forms a flow restrictor for the space between the feedwater inlet pipe 49 and the sleeve 77. In the event of a break, this restricts both the flow of water inwardly toward the reactor primary coolant and the flow of primary coolant in the opposite direction toward the exterior of the pressure vessel.

A stud 87 extends downwardly from the lower surface of the tubesheet 71. A filter screen 89 is positioned to provide filtering for the feedwater passing upwardly through the feedwater conduit or pipe 49. The screen is secured on the stud 87 by a suitable threaded nut 91.

Also positioned on the stud 87 is a horizontal flow restrictor plate 93. The plate 93 is of generally circular outline and occupies substantially all the cross-sectional interior space formed by the annular wall 69. To stabilize the plate 93 at the periphery, a plurality of rods 95 are fastened to the plate by threaded nuts 96 and extend upwardly into the outermost tubes 97 of the tubesheet 71. Orifices 99 are secured to the rods 95 to provide a tight fit in the tubes 97 and thus stabilize equilibrium of the orifice holder plate 93.

Figure 4:
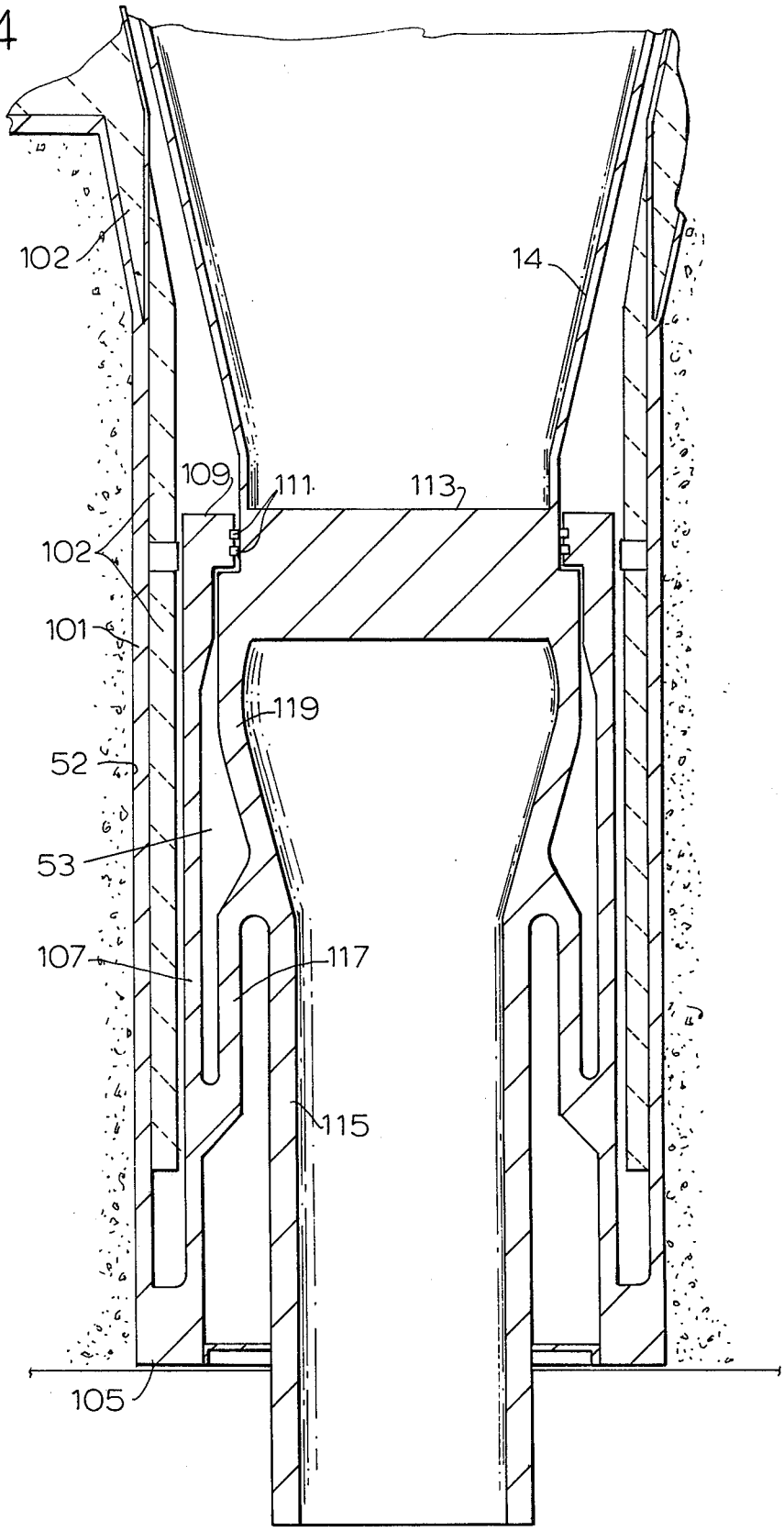
FIG. 4 is an enlarged view of the superheater outlet means of the system of FIG. 1.

In FIG. 4, the superheat tubesheet assembly is illustrated positioned within the reactor penetration 52. The reactor penetration 52 is provided with a metal liner 101. Thermal insulation 102 is provided in the penetration adjacent the liner 101. Toward the lower end of the penetration, the liner 101 is provided with an annular shelf 105 from which a sleeve 107 extends upwardly integral therewith. The upper end of the sleeve 107 is provided with an inwardly extending flange 109. The inner periphery of the flange 109 is provided with a pair of annular seals 111 which seal the periphery to the outer periphery of the superheater tubesheet 113. The superheater tubesheet 113 is supported spanning the upper end of the superheater outlet conduit 115. The conduit 115 is joined to the tubesheet 113 by suitable means, such as welding, and is further supported by a support sleeve 117 having its lower end formed integral with and extending from the sleeve 107 and having its upper end integral with and extending from the flanged upper end 119 of the superheater outlet conduit 115.

The shroud 14 for the superheater extends upwardly from the tubesheet and is welded or otherwise suitably attached thereto.

As may be seen from both FIG. 4 and FIG. 1, the superheater header 53 including the tubesheet 113 is recessed entirely within the penetration 52. In other words, the superheater tubesheet 113 is positioned a substantial distance both from the steam generator cavity 21 and from the exterior of the reactor vessel 23. In this way, the tubesheet assembly is thermally protected from the interior of the reactor vessel. An additional advantage from positioning the superheater header as shown is that the effective length of the straight section of the superheater is increased within the cavity 21, providing greater heat transfer area. Finally, and possibly most importantly, because the superheater outlet conduit 115 is subject to possible failure, a catastrophic failure of this element will be confined to the penetration 52 and will not result in flailing or wild oscillation of the broken end of the pipe as could result if the superheater header 53 were positioned inside the cavity 21.

To summarize, the configuration of the nuclear reactor system as above described makes more efficient use of or, conversely, reduces the size of, the prestressed concrete reactor vessel cavity containing the steam generator. This results from the provision of dual feedwater penetrations requiring a smaller diameter cavity for a given steam generator capacity. Moreover, because of the greater distribution provided by dual feedwater penetrations, less routing of tubes internally of the pressure vessel is required. By recessing the superheater tubesheet, the effective length of the straight superheater section is increased for a given cavity size. Flailing in the event of failure of the superheater conduit is prevented. By providing for a removable feedwater pipe, in-service access to the feedwater tubesheet is readily provided. The top hung integral restainer/flow restrictor plate in the feedwater tubesheet prevents excessive leakage of water into the primary coolant, and excessive leakage of primary coolant out of the reactor vessel, in the event of failures.

It may be seen, therefore, that the invention provides an improved nuclear reactor system wherein a prestressed concrete reactor vessel is employed with cavities therein for steam generators. More particularly, the invention provides for more efficient use of steam generator cavity volume, while at the same time providing for increased safety and in-service access.

Various modifications of the invention in addition to those shown and described herein will become apparent to those skilled in the art from the foregoing description and accompanying drawings. Such modifications are intended to fall within the scope of the appended claims.

We claim:

1. In a nuclear reactor system having a prestressed concrete reactor vessel with at least one cylindrical cavity therein for a steam generator including a feedwater tubesheet and a superheater tubesheet, the improvement comprising at least two feedwater penetrations in said reactor vessel communicating between the exterior of said reactor vessel and said cylindrical cavity, said feedwater penetrations having mutually parallel axes parallel to an extension of the axis of said cylindrical cavity, feedwater inlet means in said feedwater penetrations, a superheater penetration communicating between the exterior of said reactor vessel and said cylindrical cavity, said superheater penetration having an axis parallel to the axes of said feedwater penetrations and being substantially aligned with the axis of said cylindrical cavity, and superheater outlet means in said superheater penetration, said superheater outlet means including a tubesheet positioned in said superheater penetration a substantial distance from both said cylindrical cavity and the exterior of said reactor vessel.

2. The system of claim 1 wherein said feedwater penetrations are diametrically opposed and symmetrically located with respect to an extension of the axis of said cylindrical cavity.

3. A system in accordance with claim 1 wherein each of said feedwater inlet means include a feedwater pipe and a tubesheet positioned in said respective feedwater penetrations a substantial distance from both said cylindrical cavity and the exterior of said reactor vessel.

4. A system in accordance with claim 1 wherein said feedwater penetrations are diametrically opposed and symmetrically located with respect to an extension of the axis of said cylindrical cavity, and wherein a pair of reheat penetrations are provided in said reactor vessel communicating between the exterior of said reactor vessel and said cylindrical cavity, said reheat penetrations being diametrically opposed and symmetrically located with respect to an extension of the axis of said cylindrical cavity and having mutually parallel axes parallel with said extension of the axis of said cylindrical cavity, said reheat penetrations being located on a diameter which is substantially perpendicular to the diameter upon which said feedwater penetrations are located.

5. A system in accordance with claim 3 wherein each of said feedwater pipes is bolted to a respective tubesheet forming a removable bolted joint for providing access to the feedwater penetration for inservice inspection of the pressure boundary and tubes.

6. A system in accordance with claim 3 wherein a frustoconical flow restrictor sleeve is positioned in each of said feedwater penetrations surrounding said feedwater pipe at a location between said tubesheet and the exterior of said reactor vessel.

* * * * *